United States Patent [19]

Hotate et al.

[11] Patent Number: 4,662,339

[45] Date of Patent: May 5, 1987

[54] AIR-FUEL RATIO CONTROL FOR INTERNAL COMBUSTION ENGINE

[75] Inventors: Makoto Hotate; Toshio Nishikawa, both of Hiroshima; Yoshitaka Tabara, Higashihiroshima, all of Japan

[73] Assignee: Mazda Motor Corporation, Hiroshima, Japan

[21] Appl. No.: 813,933

[22] Filed: Dec. 27, 1985

[30] Foreign Application Priority Data

Jan. 18, 1985 [JP] Japan ..... 60-8226

[51] Int. Cl.[4] ..... F02D 41/04

[52] U.S. Cl. ..... 123/486; 123/478

[58] Field of Search ..... 123/486, 492, 493, 478, 123/480

[56] References Cited

U.S. PATENT DOCUMENTS 4,319,327 3/1982 Higashiyama et al. ..... 123/486
4,332,226 6/1982 Nomura et al. ..... 123/478
4,399,791 8/1983 Kobayashi et al. ..... 123/489
4,413,602 11/1983 Inoue et al. ..... 123/486
4,561,403 12/1985 Oyama et al. ..... 123/492

FOREIGN PATENT DOCUMENTS 56-115838 9/1981 Japan .
58-158345 9/1983 Japan ..... 123/486

*Primary Examiner*—Andrew M. Dolinar
*Attorney, Agent, or Firm*—Burns, Doane, Swecker & Mathis

[57] ABSTRACT

An air-fuel ratio control system for an automobile engine including an intake passage having a throttle valve, and a fuel supply unit, which comprises an air detector for generating an air signal indicative of the quantity of air sucked to the engine through the intake passage, a throttle detector for generating a throttle signal indicative of the opening of the throttle valve, and a control unit operable in response to the signals from the air and throttle detectors for determining the air-fuel ratio of a combustible air-fuel mixture to be supplied to the engine in dependence on the amount of air sucked when a load on the engine is small, but on the opening of the throttle valve when the load on the engine is great.

6 Claims, 9 Drawing Figures

AIR-FUEL RATIO CONTROL FOR INTERNAL COMBUSTION ENGINE

BACKGROUND OF THE INVENTION

The present invention generally relates to an air-fuel ratio control system for an internal combustion engine and, more particularly, to the control system for controlling the air-fuel mixing ratio of a combustible air-fuel mixture in dependence on an engine operating condition.

For the purpose of this specification, the terms "leaned operating range" and "enriched operating range" herein used are to be understood as meaning a condition during which the internal combustion engine is operated with the supply of a leaned air-fuel mixture and that during which it is operated with the supply of an enriched air-fuel mixture, respectively.

There is well known an air-fuel ratio control system for controlling the air-fuel ratio of the combustible air-fuel mixture in dependence on an engine operating condition detected in reference to a combination of parameters including, for example, the suction pressure developed inside an intake system of the engine, the quantity (or flow rate) of air being sucked through the intake system and the engine speed. (See, for example, Japanese Laid-open Patent Publication No. 56-115838 laid open to public inspection on Sept. 11, 1981).

For the purpose of minimizing the fuel consumption and the emission of obnoxious exhaust gases, attempts have recently been made to increase the leaned operating range of the engine as large as possible.

However, the increase of the leaned operating range necessarily results in the approximation to the enriched operating range, and will bring about such a problem that even a slight change in engine operation condition may be liable to result in the shift from the leaned operating condition to the enriched operating condition and back to the leaned operating condition with the consequence that an engine torque shock incident to an abrupt change in air-fuel ratio may occur. This will be discussed in detail with particular reference to FIG. 1 of the accompanying drawings which illustrates the change in suction pressure with change in throttle opening while the engine speed is fixed at 1,500 rpm.

As shown in FIG. 1, when and so long as the throttle opening, i.e., the opening of a throttle valve disposed in the inake system of the engine, is smaller than 20 degrees, the suction pressure changes at a great gradient with change in throttle opening, but when and so long as it is equal to or greater than 20 degrees, the change in suction pressure relative to the change in throttle opening becomes extremely small with the result that the responsivity to the change in throttle opening is extremely lowered. (In other words, the suction pressure is brought in a substantially saturated condition when the throttle opening exceeds 20 degrees.) The 20 degrees of the throttle opening referred to above corresponds to the suction pressure (−50 mmHg) attained at the time of maximum foot depression during an EM mode, and if the leaned operating range is increased to this operating range, a slight change in suction pressure which is a factor used to control the air-fuel ratio results in the shift from the leaned operating range to the enriched operating range, and vice versa, accompanied by an abrupt change in air-fuel ratio to such an extent as to result in the torque shock. The above described abrupt change in air-fuel ratio also brings about a change in both the quantity of the air being sucked and the suction pressure, which are factors used to control the air-fuel ratio, resulting in the occurrence of a sort of hunting phenomenon wherein a reciprocating shift between the leaned operating range and the enriched operating range takes place. Once this hunting phenomenon occurs, the drivability will be adversely affected, imposing a limitation on the expansion of the leaned operating range.

Moreover, since the change in quantity of the air being sucked and that in suction pressure are both extremely small during the enriched operating range, the control responsivity tends to be lowered to such an extent as to result in the difficulty in accurate air-fuel control.

For substantially eliminating the above described problems, it may be contemplated to determine a target air-fuel ratio in reference to the throttle opening. However, since during a low load engine operating condition wherein the throttle opening is small, the change in quantity of the air being sucked relative to the throttle opening does not exhibit a linear characteristic, the determination of the target air-fuel ratio is not easy and is not desirable in terms of fuel consumption and drivability.

SUMMARY OF THE INVENTION

The present invention is therefore to provide an improved air-fuel ratio control system effective to substantially eliminate, without unnecessarily narrowing the leaned operating range, instability in air-fuel ratio control which may occur at a region of transit between the leaned and enriched operating conditions, which instability poses a problem hampering the increase of the leaned operating range such as discussed above.

In order to accomplish the above described object, an improved air-fuel ratio control system according to the present invention comprises a flow detecting means for detecting the flow of air being sucked by the engine, a load detecting means for detecting the load imposed on the engine, a throttle detecting means for detecting the opening of the throttle valve, a first ratio determining means operable, in response to an output from the load detecting means indicative of the load being smaller than a predetermined value, to determine a target air-fuel ratio of the combustible mixture to be supplied to the engine in dependence on an output from the flow detecting means, a second ratio determining means operable, in response to an output from the load detecting means indicative of the load exceeding the predetermined value, to determine a target air-fuel ratio of the combustible air-fuel mixture to be supplied to the engine in dependence on an output from the throttle detecting means, and a ratio regulating means for regulating the air-fuel ratio of the combustible air-fuel mixture to the target air-fuel ratio determined by one of the first and second ratio determining means.

With this construction according to the present invention, the air-fuel ratio can be controlled in dependence on the suction pressure and the quantity of the air being sucked, when and so long as the load on the engine is smaller than the predetermined value, but in dependence on the throttle opening when and so long as the load on the engine is in excess of the predetermined value. Accordingly, the air-fuel ratio control can be accurately performed at all engine operating conditions, and above all, the air-fuel ratio control at the region of transit between the leaned and enriched operating ranges can advantageously be stabilized.

BRIEF DESCRIPTION OF THE DRAWINGS

This and other objects and features of the present invention will become clear from the following description taken in conjunction with a preferred embodiment thereof with reference to the accompanying drawings, in which.

DETAILED DESCRIPTION OF THE EMBODIMENT

Figure 1:
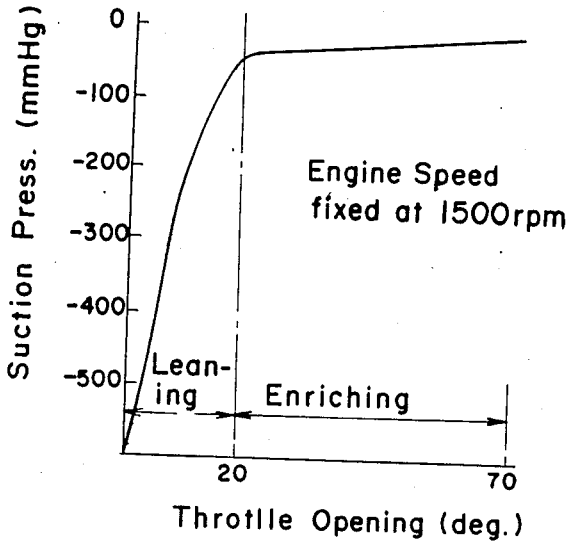
FIG. 1 is a graph showing how the suction pressure changes with change in throttle opening when the engine speed is fixed at a particular value.
Figure 2:
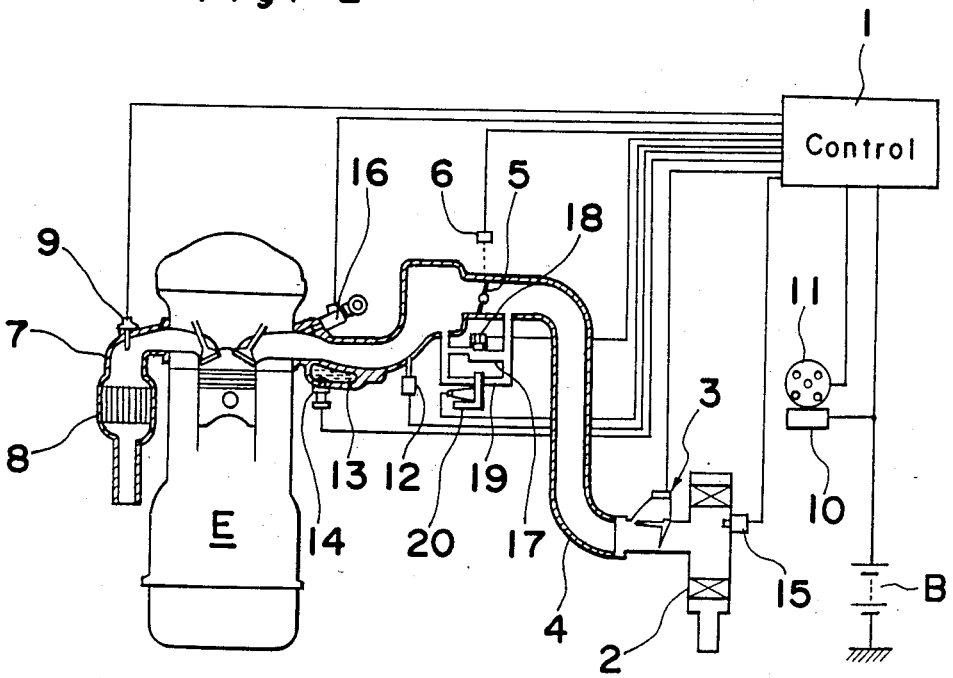
FIG. 2 is a schematic diagram showing an automobile internal combustion engine utilizing an air-fuel ratio control system according to the present invention.

Referring to FIG. 2, an automobile power plant shown therein includes an internal combustion engine E having an intake passage 4 for the introduction of air from the atmosphere into a combustion chamber through an air cleaner 2, and an exhaust passage 7 for the discharge of exhuast gases from the combustion chamber to the atmosphere through an exhaust gas purifying unit 8, for example, a catalytic converter. The intake passage 4 includes an air flowmeter 3 for measuring, and generating an air signal indicative of, the flow of air sucked into the intake passage through the air cleaner 2 during the operation of the engine as is well known to those skilled in the art, a throttle valve 5 disposed therein downstream of the air flowmeter 3 with respect to the direction of flow of the air towards the engine E, and an electronically controlled fuel injector 16 disposed therein adjacent an intake port of the engine E for injecting fuel in a controlled quantity required to form a combustible air-fuel mixture in admixture with the air being sucked.

The intake passage 4 also includes a first bypass passage 17 bypassing the throttle valve 5 and having a solenoid valve 18 operable during the idling of the engine E for the supply of idling air and a second bypass passage 19 also bypassing the throttle valve 5 and having an air valve 20 disposed therein for the supply of air during the cold start of the engine E. The engine E has a water jacket 13 for the flow of a cooling water used to cool the engine E during the operation of the engine E.

The engine system so far described is of a known construction and, therefore, the details thereof will not be further described for the sake of brevity.

The automobile power plant also comprises a control unit 1 constituted by a microcomputer and adapted to receive the following numerous signals:

Air signal: Generated from the air flowmeter 3 and indicative of the flow of air being sucked through the intake passage 4.

Throttle signal: Generated from a throttle sensor 16 operatively coupled with the throttle valve 5, and indicative of the opening of the throttle valve 5 in terms of degree.

Air-fuel signal: Generated from and $O_2$ sensor disposed in the exhaust passage 7 upstream of the catalytic converter 8 with respect to the direction of flow of the exhaust gases, and indicative of the air-fuel ratio of the combustible mixture burned in the engine E. This signal is capable of assuming two different states one at a time representing the enriched and leaned conditions of the combustible mixture, respectively.

On-off signal: Generated from a distributor 11 for driving an igniter 10 of an automobile ignition system, and indicative of the operative state of the distributor 11.

Pressure signal: Generated from a pressure sensor 12 disposed in the intake passage 4 between the injector 16 and the throttle valve 5, and indicative of the suction pressure developed inside the intake passage 4.

Water temperature signal: Generated from a temperature sensor 14 disposed in the water jacket 13 and indicative of the temperature of the cooling water.

Air temperature signal: Generated from an air temperature sensor 15 disposed in the air cleaner 2 and indicative of the temperature of the air being sucked into the intake passage 4 through the air cleaner 2.

Battery signal: Generated from, and indicative of the voltage stored in, a battery unit B.

The control unit 1 is capable of generating numerous drive signals for controlling the fuel injector 16, the solenoid valve 18, the air valve 20, and others, respectively.

While the control unit 1 executes not only the control of the air-fuel ratio of the combustible mixture as will be described subsequently, but also the control of the solenoid valve 18, the air valve 20 and the others, the latter will not be herein described in detail for the sake of brevity because the control of the valves 18 and 20 and the others is not a part of the subject matter of the present invention.

Figure 3:
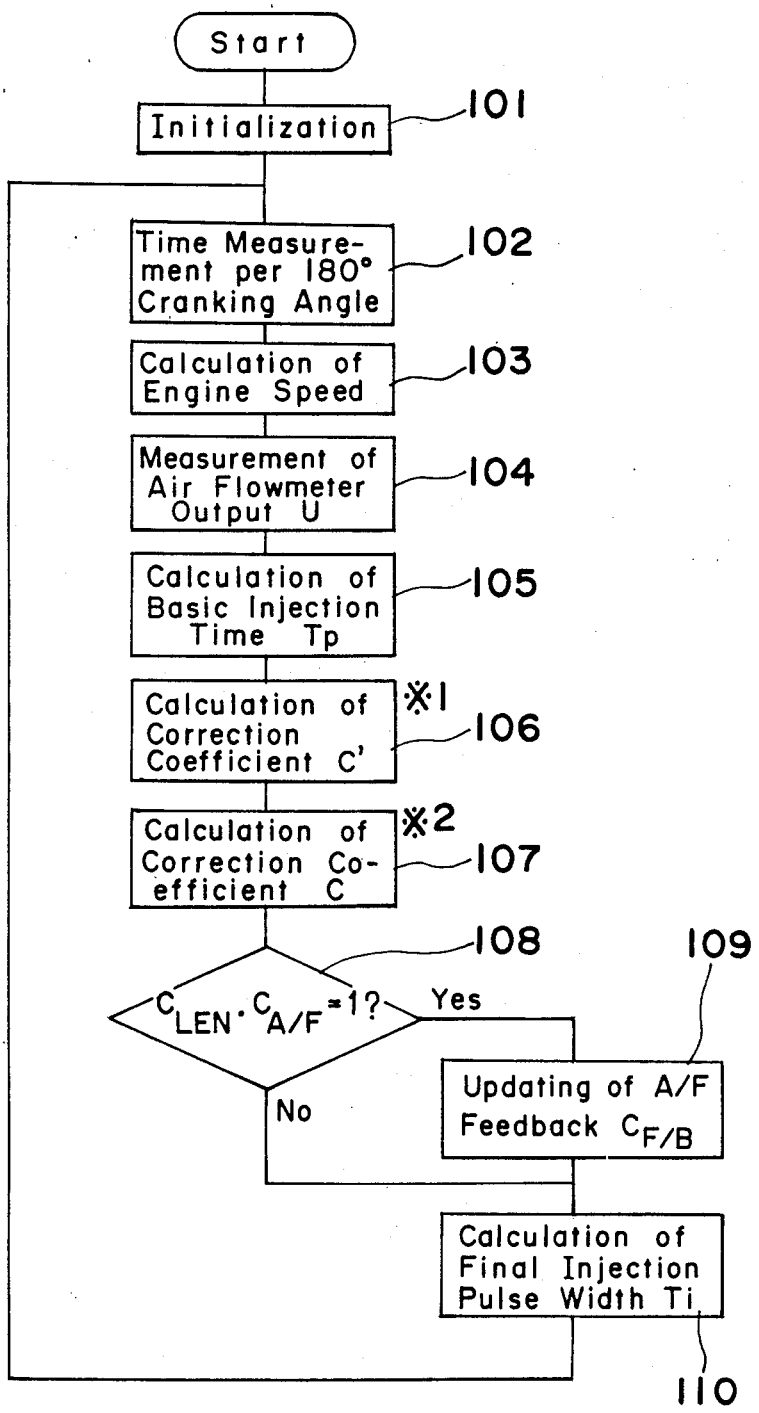
FIG. 3 is a flowchart showing the sequence of control of the air-fuel ratio control according to the present invention.

The air-fuel ratio control executed by the control unit 1 will now be described with reference to the flowchart of FIG. 3.

Subsequent to the start of the air-fuel ratio control and at step 101, initialization takes place. At the subsequent step 102, the time is measured for each 180° of cranking angle CA and, on the basis of the time so measured, the engine speed in terms of number of revolutions per minute is detected at step 103. An output U from the air flowmeter 3 is read in at step 104, followed by step 105 at which a basic injection pulse (time) $T_P$ is calculated with the use of the engine speed and the output U from the air flowmeter 3. Although not shown, the calculation of the basic injection pulse width $T_P$ can be executed by the use of a map for the determination of the basic injection pulse, which map is stored in a memory in the microcomputer and utilizes the engine speed and the quantity of air sucked as respective parameters. Alternatively, it may be done by the use of predetermined formulas without using the map.

Figure 4:
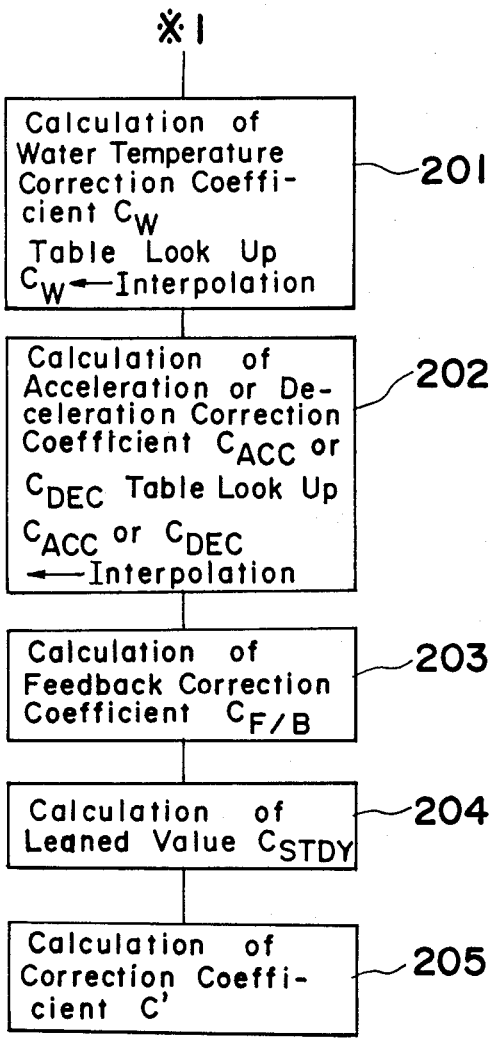
FIGS. 4 and 5 are flowcharts showing the details of two steps shown in FIG. 3, respectively.

At step 106, a correction coefficient C' for the basic injection pulse width $T_P$ calculated at the previous step 105 is calculated, the details of which step 106 are shown in FIG. 4. Referring to FIG. 4, and at step 201, the water temperature signal fed from the temperature sensor 14 is read in for the purpose of calculating a water temperature correction coefficient $C_W$. This calculation is performed on the basis of a table (not shown) stored in a memory of the microcomputer in such a way as to interpolate data stored in the table to render it to correspond to the detected temperature of the cooling water, thereby to provide the water temperature correction coefficient $C_W$. At the subsequent step 202, acceleration and deceleration correction coefficients $C_{ACC}$ and $C_{DEC}$, respectively, are calculated. The calculation of the correction coefficients $C_{ACC}$ and $C_{DEC}$ can be achieved by interpolation with reference to a table stored in a memory of the microcomputer in a manner similar to the calculation of the water temperature correction coefficient, although the details thereof are not shown therein.

A feedback correction coefficient $C_{F/B}$ is calculated at step 203 subsequent to step 202. This feedback correction coefficient $C_{F/B}$ can be calculated by obtaining a term of proportion and/or a term of integral in any known manner in dependence on the air-fuel signal generated from the $O_2$ sensor 9 during the feedback control mode for controlling the air-fuel ratio in dependence on the output of the $O_2$ sensor 9. During the non-feedback control mode, however, the feedback correction coefficient $C_{F/B}$ is rendered to be "0". Subsequent to the calculation of the feedback correction coefficient $C_{F/B}$, and at step 204, the calculation of a learned value $C_{STDY}$ is performed. The learned value $C_{STDY}$ is a variable obtained by studying corrections executed up until this time during the feedback control, and a method of study may be of any known method. At step 205, a correction coefficient C' is determined by the use of the various correction coefficients determined during the program flow from step 201 to step 204. More specifically, $$C' = 1 + C_W + C_{ACC} + C_{DEC} + C_{F/B} + C_{STDY}$$

Referring again to FIG. 3, and after the calculation of the correction coefficient C' at step 106 according to the program flow shown in FIG. 4, another correction coefficient C is calculated at step 107 according to a program flow shown in FIG. 5, reference to which will now be made.

At step 301, an air temperature correction coefficient $C_{AIR}$ is calculated from the temperature of the air being sucked, which has been detected by the air temperature sensor 15, by interpolation with the use of a table stored in a memory of the microcomputer for this purpose. An atmospheric pressure correction coefficient $C_{BAR}$ is subsequently calculated at step 302 from the atmospheric pressure, detected by an atmospheric pressure sensor not shown in FIG. 2, by interpolation with the use of a table stored in a memory of the microcomputer.

Figure 6:
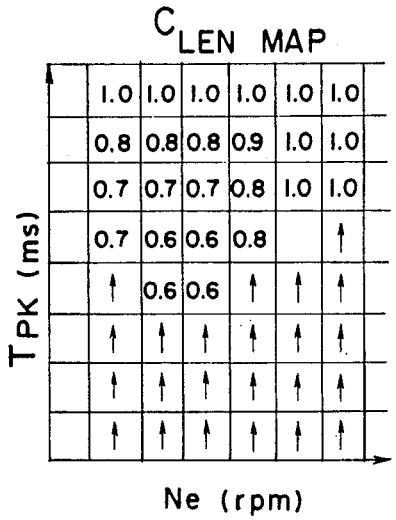
FIG. 6 is a diagram showing a map used to calculate a leaning correction coefficient $C_{LEN}$.

At the subsequent step 303, a leaning correction coefficient $C_{LEN}$ is calculated with the use of a map shown in FIG. 6. The map $C_{LEN}$MAP used for the calculation of the leaning correction coefficient $C_{LEN}$ has a plurality of address locations bearing such respective numerical values as shown, which address locations are divided according to respective combination of engine speeds Ne and fuel injection pulse widths Tpk. At an engine operating range represented by any numerical value smaller than 1.0 stored in the map as shown in FIG. 6, the correction is effected to lean the combustible mixture, but at an engine operating range represented by the numerical value "1.0", no correction is effected to lean the combustible mixture. The leaning correction coefficient $C_{LEN}$ can be determined by interpolation with the use of the map described above and with reference to FIG. 6.

Figure 7:
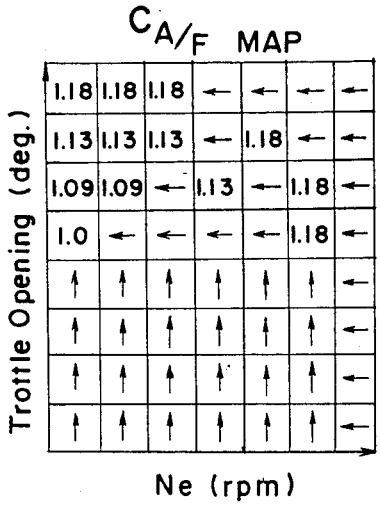
FIG. 7 is a diagram showing a map used to calculate and enriching correction coefficient $C_{A/F}$.

Referring again to FIG. 5, and at step 304, an enriching correction coefficient $C_{A/F}$ is calculated with the use of a map $C_{A/F}$MAP shown in FIG. 7 and stipulated for the determination of the enriching correction coefficient $C_{A/F}$. As shown in FIG. 7, the map $C_{A/F}$MAP has a plurality of address locations bearing such numerical values as shown, which address locations are divided according to respective combinations of engine speeds Ne and throttle openings. Characteristic of this map is that, as the engine operating condition shifts towards a high load, high speed operating condition, the numerical value gradually increases so that the enriched combustible mixture can be supplied to the engine during the high load engine operating condition. Thus, at step 304, the enriching correction coefficient $C_{A/F}$ is determined by interpolation from the $C_{A/F}$MAP on the basis of the throttle opening detected by the throttle sensor 6 and the engine speed then assumed by the engine. It is however to be noted that the coefficient $C_{A/F}$ takes a value "1" during an operating range other than the enriched operating range.

At step 305, the correction coefficient C is determined by multiplying the various coefficients determined during the program flow from step 301 to step 304. Namely, $$C = C_{AIR} \cdot C_{BAR} \cdot C_{LEN} \cdot C_{A/F}$$

Figure 5:
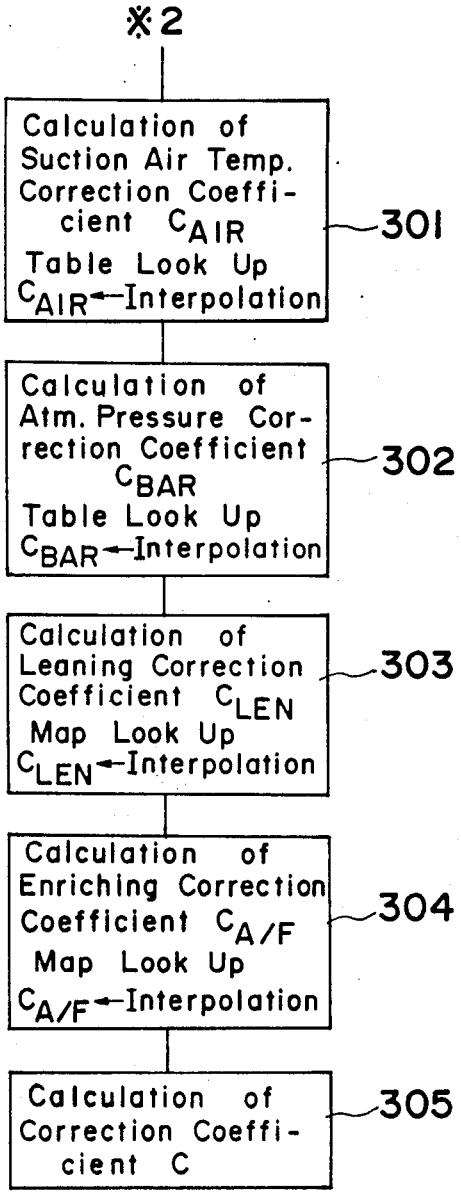

Referring back to FIG. 3, and after the calculation of the correction coefficient C at step 107 according to the program flow shown in FIG. 5, a decision is made at step 108 to determine if the product of the leaning correction coefficient $C_{LEN}$ multiplied by the enriching correction coefficient $C_{A/F}$ is 1. Where the product is 1, indicating that the feedback control is performed, the program flow proceeds to step 109 at which the feedback correction coefficient $C_{F/B}$ is updated. On the other hand, where the product represents a value other than 1, indicating that no feedback control is performed, no feedback correction coefficient $C_{F/B}$ is updated (and, instead, the previous feedback correction coefficient $C_{F/B}$ is utilized) and a final injection pulse width Ti is calculated at step 110. The calculation of this pulse width Ti also takes place subsequent to the updating of the feedback correction coefficient $C_{F/B}$ in the event of the feedback control scheme. The calculation performed at step 110 takes place using the following equation.

$$Ti = \tau A \cdot C' + Tv$$

$$(\tau A = Tp \cdot Ck \cdot C = Tpk \cdot C)$$

wherein Tv represents a battery voltage correction, Ck represents a constant peculiar to the fuel injector (fuel injecting valve) 16 used, and Tpk is equal to the product of Tp multiplied by Ck and is determined of the actual injection pulse width.

Figure 8:
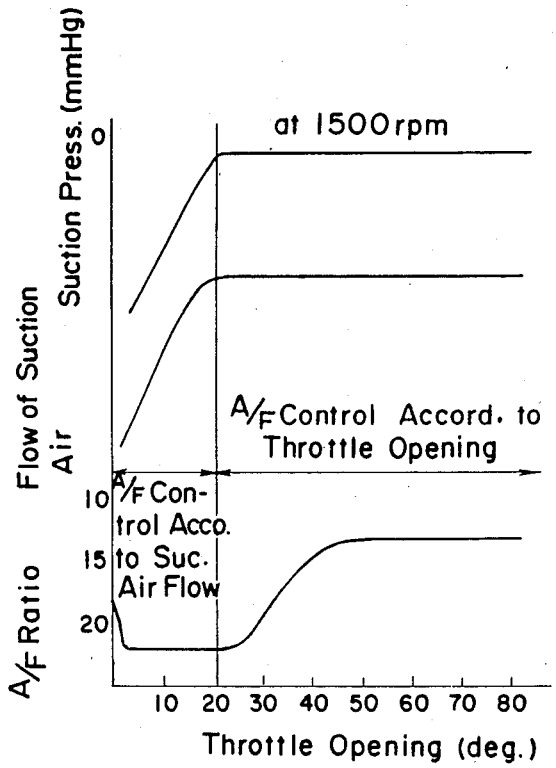
FIG. 8 is a graph showing a change in air-fuel ratio obtained by the air-fuel ratio control according to the present invention.

As a result of the air-fuel control executed in the manner as hereinbefore described, and when the engine speed is fixed at 1500 rpm, it has been found that, as shown in the graph of FIG. 8, during the engine operating condition with the throttle opening being smaller than 20 degrees, the air-fuel ratio control can be achieved in dependence on the quantity of the sucked air which exhibits a relatively great gradient of variation during this condition, but during the engine operating condition with the throttle opening exceeding 20 degrees, the air-fuel ratio control is performed in dependence on the throttle opening in such a way that, as the throttle opening increases in excess of 20 degrees, the air-fuel ratio varies from a high value to a low value at a relatively moderate gradient. Therefore, even during the shift from the leaned operating range towards the enriched operating range, and vice versa, the air-fuel ratio can be smoothly controlled with no possibility of the air-fuel ratio being abruptly changed such as occurring in the prior art system.

Figure 9:
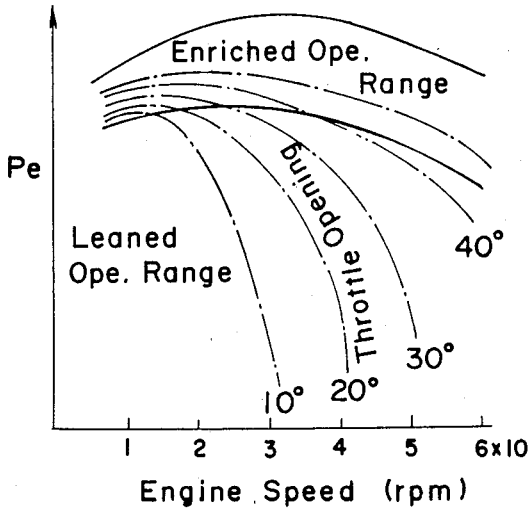
FIG. 9 is a graph showing the relationship between the engine speed and the average effective pressure wherein the throttle opening is taken as a parameter.

This will be described with reference to FIG. 9 which illustrates a change in average effective pressure Pe (engine output) with change in engine speed when the throttle opening is fixed at a predetermined degree. In FIG. 9, the enriched operating range falls within a region bound between the spaced solid lines, and the leaned operating range falls within a region below the enriched operating range. In this case, since during the transit between the enriched and leaned operating range the air-fuel ratio is controlled in dependence on the throttle opening, not only the abrupt change in air-fuel ratio, but also the incident abrupt change in suction pressure as well as quantity of the air being sucked can be assuredly avoided during the shift between the enriched and leaned operating ranges.

Although in the foregoing description of the preferred embodiment, reference has been made to the air-fuel ratio control, it is preferred to control the ignition timing of the engine system according to the air-fuel ratio controlled in the manner as hereinbefore described.

Assuming that a target ignition timing is expressed by $\theta ig$, this ignition timing $\theta ig$ can be determined as follows:

$$\theta ig = \theta_{BASE} + \theta_{EGR} + \theta_{wt} - \theta_{ACC} + \theta_{LEN} + \theta_{A/F}$$

wherein $\theta_{BASE}$ represents a basic ignition timing determined according to a predetermined map; $\theta_{EGR}$ represents an amount of correction during the recirculation of a portion of the exhaust gases; $\theta_{wt}$ represents an amount of correction dependent on the temperature of the engine cooling water; $\theta_{ACC}$ represents an amount of correction during the acceleration; $\theta_{LEN}$ represents an amount of correction during the leaned operating range; and $\theta_{A/F}$ represents an amount of correction during the air-fuel ratio control range (enriched operating range) based on the throttle opening.

It is, therefore, preferred to execute a control of the ignition timing by determining it according to the above equation.

Where the throttle valve is operatively coupled with an accelerator pedal, the opening of the accelerator pedal may be employed in place of the throttle opening.

In the foregoing embodiment of the present invention, the maps used to determine the various correction coefficients may not be always essential, but arithmetic equations may be employed instead of the maps. By way of example, as a parameter specifying an address in the map, the quantity of the air sucked may be employed instead of the injection pulse width Tpk.

Although the present invention has been described in connection with the preferred embodiments thereof with reference to the accompanying drawings, it is to be noted here that various changes and modifications are apparent to those skilled in the art. Such changes and modifications, some of which have been suggested above, are to be understood as included within the scope of the present invention as defined by the appended claims, unless they depart therefrom.

What is claimed is:

1. An air-fuel ratio control system for an internal combustion engine having intake passage means and exhaust passage means, said intake passage means including a throttle valve disposed therein and a fuel injector for injecting a controlled amount of fuel thereinto, which system comprises:

(a) first detecting means for detecting, and providing an intake air signal indicative of, the amount of intake air supplied to a combustion chamber of the engine;

(b) second detecting means for detecting, and providing an engine speed signal indicative of, the engine speed;

(c) third detecting means for detecting, and providing a throttle signal indicative of, the opening of the throttle valve in the intake passage means;

(d) means operable in response to the intake air signal and the engine speed signal for determining, and providing a fuel signal indicative of, the basic quantity of fuel to be injected;

(e) leaning coefficient determining means operable in response to the application of both the intake air signal and the engine speed signal or both the engine speed signal and the fuel signal thereto for generating a first output signal for reducing the basic quantity of fuel when the intake air signal or the fuel signal is lower than a predetermined value, and for generating a second output signal for not varying the basic quantity of fuel when the intake air signal or the fuel signal is higher than the predetermined value;

(f) enriching coefficient determining means operable in response to the application of both the engine speed signal and the throttle signal thereto for generating a third output signal for increasing the basic quantity of fuel in correspondence with an increase in throttle opening when the throttle signal is higher than a predetermined value, and for generating a fourth output signal for not varying the basic quantity of fuel when the throttle signal is lower than the predetermined value;

(g) calculating means operable in response to both one of the first and second output signals and one of the third and fourth output signals for calculating, and providing a correction signal indicative of, a final correction value in dependence on both said one of the first and second output signals and said one of the third and fourth output signals; and (h) correcting means operable in response to the fuel signal and the correction signal to correct the basic quantity of fuel by the final correction value and to output a result of the correction of the fuel injector.

2. The system as claimed in claim 1, wherein said correcting means is operable to multiply the fuel signal times the correction signal.

3. The system as claimed in claim 1, wherein said leaning coefficient determining means comprises a memory utilizing the engine speed signal and the fuel signal as respective parameters for generating an output signal indicative of a value smaller than 1 when the fuel signal is lower than the predetermined value, and an output signal indicative of a value equal to 1 when the fuel signal is higher than the predetermined value.

4. The system as claimed in claim 1, wherein said enriching coefficient determining means comprises a memory capable of generating an output signal indicative of a value greater than 1 when the throttle signal is higher than the predetermined value, and an output signal indicative of a value equal to 1 when both the throttle signal and the engine speed signal are lower than the respective predetermined value.

5. The system as claimed in claim 1, wherein the first detecting means is disposed in the intake passage means for directly responding to the flow of the intake air through the intake passage means thereby to provide the intake air signal.

6. The system as claimed in claim 1, wherein said calculating means is operable to multiply one of the first and second output signals times one of the third and fourth output signals, said correction signal being the product of said one of the first and second output signals times said one of the third and fourth output signals.

* * * * *